US007070821B1

(12) United States Patent
Liang

(10) Patent No.: US 7,070,821 B1
(45) Date of Patent: Jul. 4, 2006

(54) JELLY-CONTAINING DEVICE

(76) Inventor: Ching-Yao Liang, No. 5, Lane 205, Jen Ai St., Tainan Hsien, Hsinshin Hsiang (TW)

( * ) Notice: Subject to any disclaimer, the term of this patent is extended or adjusted under 35 U.S.C. 154(b) by 0 days.

(21) Appl. No.: 10/906,961

(22) Filed: Mar. 14, 2005

(51) Int. Cl.
*B65D 85/72* (2006.01)

(52) U.S. Cl. ..... 426/115; 222/94; 426/389

(58) Field of Classification Search ..... 426/115
See application file for complete search history.

(56) References Cited

U.S. PATENT DOCUMENTS

| | | | | | |
|---|---|---|---|---|---|
| 2,939,610 | A | * | 6/1960 | Castelli et al. | 222/94 |
| 3,335,912 | A | * | 8/1967 | Reeves, Jr. | 222/94 |
| 3,472,423 | A | * | 10/1969 | Kaplan | 222/129 |
| 3,506,157 | A | * | 4/1970 | Dukess | 222/94 |
| 3,788,520 | A | * | 1/1974 | Dukess | 222/94 |
| 5,823,387 | A | * | 10/1998 | Manadanas et al. | 222/1 |
| 5,927,550 | A | * | 7/1999 | Mack et al. | 222/94 |
| 5,954,234 | A | * | 9/1999 | Connan et al. | 222/94 |

FOREIGN PATENT DOCUMENTS

| | | | | |
|---|---|---|---|---|
| AU | 2002100079 | * | 3/2002 | 426/115 |
| JP | 5-199839 | * | 8/1993 | 426/115 |
| JP | 9-226880 | * | 9/1997 | 426/115 |
| JP | 10-17068 | * | 1/1998 | 426/115 |
| JP | 10-59346 | * | 3/1998 | 426/115 |
| JP | 10-86991 | * | 4/1998 | 426/115 |

* cited by examiner

*Primary Examiner*—Steve Weinstein
(74) *Attorney, Agent, or Firm*—Alan D. Kamrath; Nikolai & Mersereau, P.A.

(57) ABSTRACT

A jelly-containing device includes a plurality of flexible sheet-shaped spacers integrally formed in the housing thereof. Mid-portions of the respective spacers are intersected with each other. Thus, an inner space of the housing is divided into a plurality of jelly-receiving spaces, and the number of jelly-receiving spaces is two times the number of the spacers. Therefore, the jelly will be equally divided into several portions that are still partially connected with each other. After being squeezed out of the jelly-receiving spaces, the jelly will be broken into pieces easily through sucking and chewing activities, thus eliminating the danger of choking.

7 Claims, 5 Drawing Sheets

JELLY-CONTAINING DEVICE

BACKGROUND OF THE INVENTION

1. Field of the Invention

The present invention relates to a jelly-containing device, and more particularly to a jelly-containing device comprising a plurality of flexible sheet-shaped spacers integrally formed in the housing thereof, with mid-portions of the respective spacers intersected with each other. Thus, an inner space of the housing is divided into a plurality of jelly-receiving spaces, and the number of jelly-receiving spaces is two times the number of the spacers. Therefore, the jelly will be equally divided into several portions that are still partially connected with each other.

2. Description of the Prior Arts

Referring to FIGS. 8–10, a conventional jelly cup is shown and comprises a housing 91 and a receiving space 92 provided for storage of jelly 93. As the size of the jelly 93 is as big as that of the receiving space 92, this will probably choke children.

The present invention has arisen to mitigate and/or obviate the afore-described problem of the conventional jelly-containing device.

SUMMARY OF THE INVENTION

The primary objective of the present invention is to provide a jelly-containing device comprising a plurality of flexible sheet-shaped spacers integrally formed in the housing thereof. Mid-portions of the respective spacers are intersected with each other. Thus, an inner space of the housing is divided into a plurality of jelly-receiving spaces, and the number of jelly-receiving spaces is two times the number of the spacers. Therefore, the jelly will be equally divided into several portions that are still partially connected with each other. After being squeezed out of the jelly-receiving spaces, and the jelly will be broken into pieces easily through sucking and chewing activities, thus eliminating the danger of choking.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
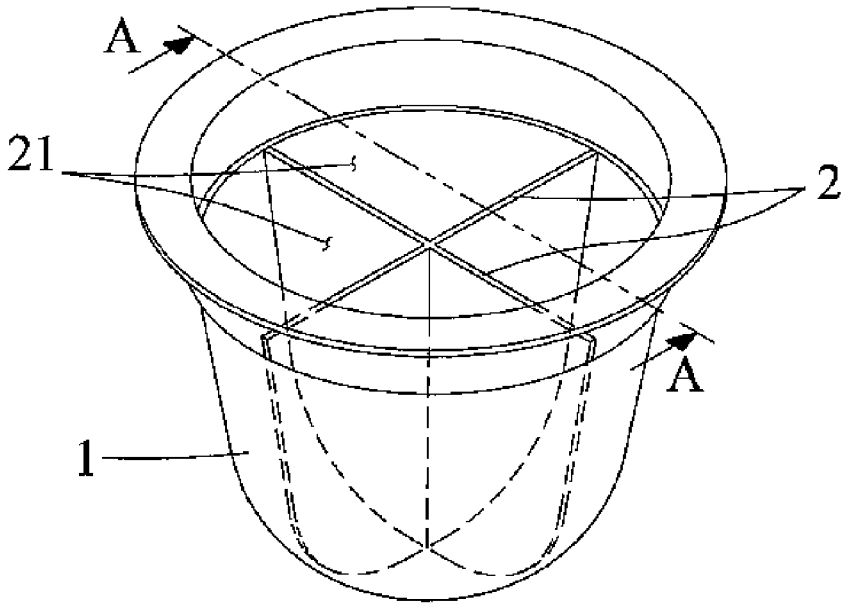
FIG. 1 is a perspective view of a jelly-containing device in accordance with present invention.
Figure 2:
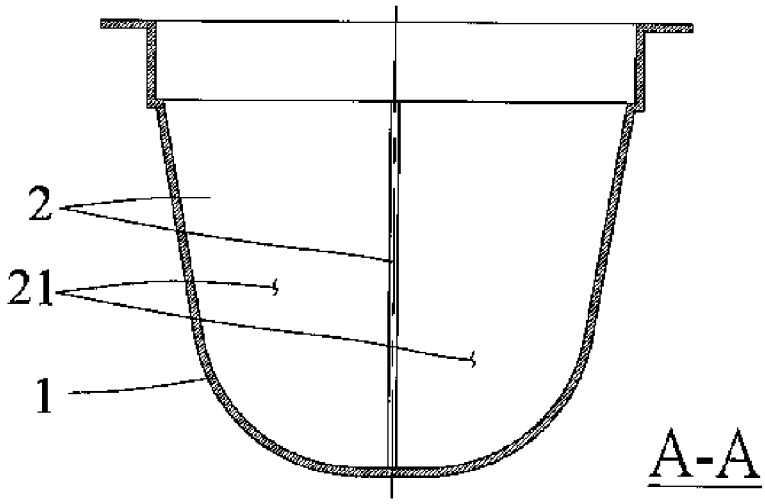
FIG. 2 is a cross sectional view of the jelly-containing device taken along the line A—A of FIG. 1.

Referring to FIGS. 1 and 2, a jelly-containing device in accordance with an embodiment of the present invention is shown and comprises a housing 1 and a plurality of spacers 2.

The housing 1 is a flexible hollow member.

Figure 3:
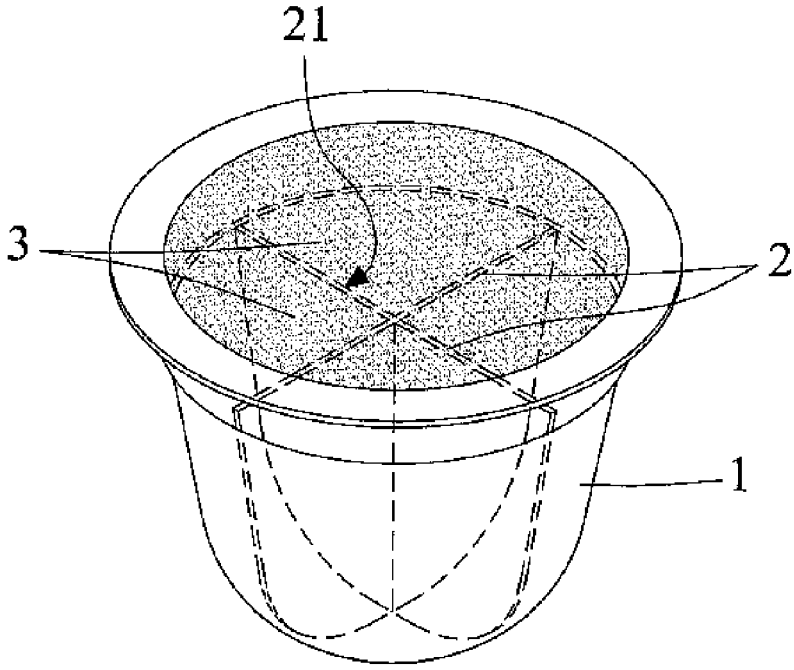
FIG. 3 shows the jelly-containing device in accordance with present invention stored with jelly.
Figure 4:
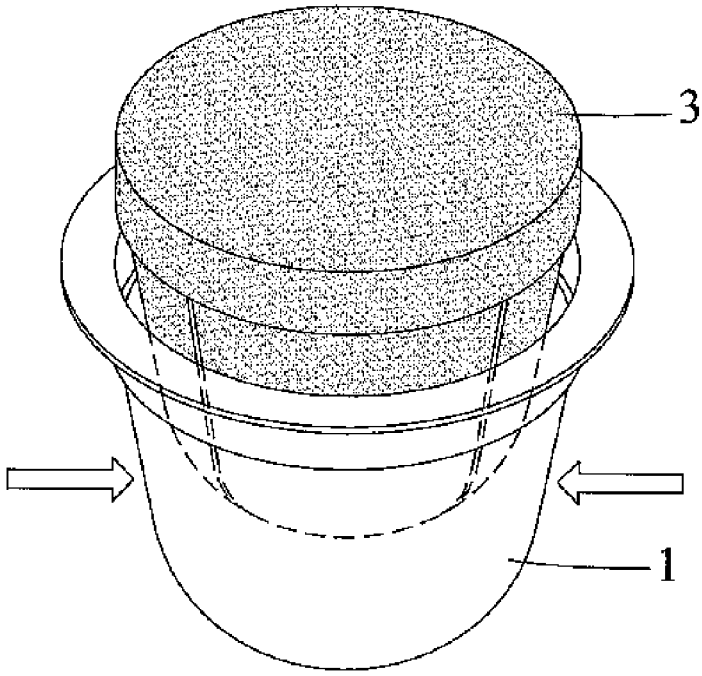
FIG. 4 shows the jelly partially squeezed out of the jelly-containing device.

The spacers 2 are flexible sheet-shaped structures integrally formed in the housing 1. Mid-portions of the respective spacers 2 are intersected with each other. Both edges and the lower edge of the respective spacers 2 are integral with the inner wall of the housing 1. The inner space of the housing 1 is divided into jelly-receiving spaces 21, the number of which is two times the number of the spacers 2. Therefore, the jelly 3 will be equally divided into several portions that are still partially connected with each other. After being squeezed out of the jelly-receiving spaces 21, as shown in FIGS. 3 and 4, the jelly 3 will be broken into pieces easily through sucking and chewing activities, thus eliminating the danger of choking.

Figure 5:
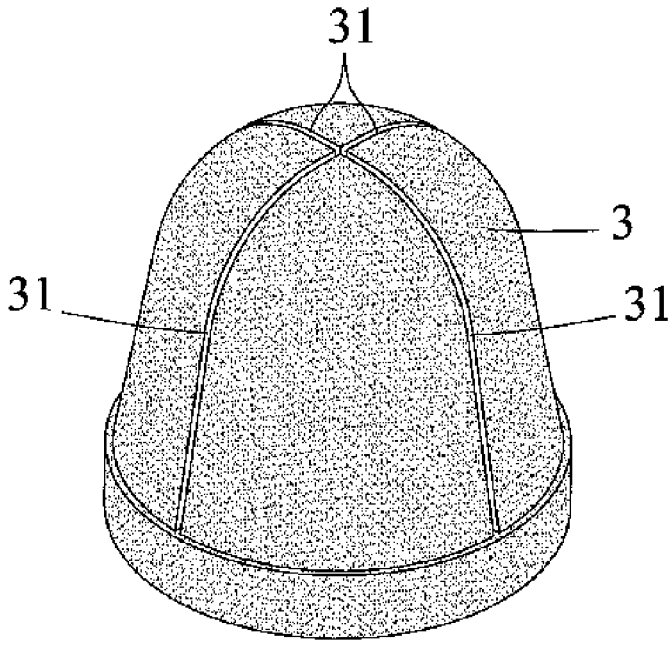
FIG. 5 shows the bottom of the jelly formed by the jelly-containing device in accordance with present invention.

The lower and the lateral edges of the spacers 2 are integral with the internal wall of the housing 1 (as shown in FIGS. 1 and 2). Thus, the spacer-induced crossed cutting line 31 will equally and partially cut the jelly 3 into several portions, and the several portions of the jelly 3 are still partially connected to each other, as shown in FIG. 5. The clearances between the crossed cutting line 31 does not choke the esophagus, and the jelly 3 will be broken into pieces easily through sucking and chewing activities, thus eliminating the danger of choking.

Figure 6:
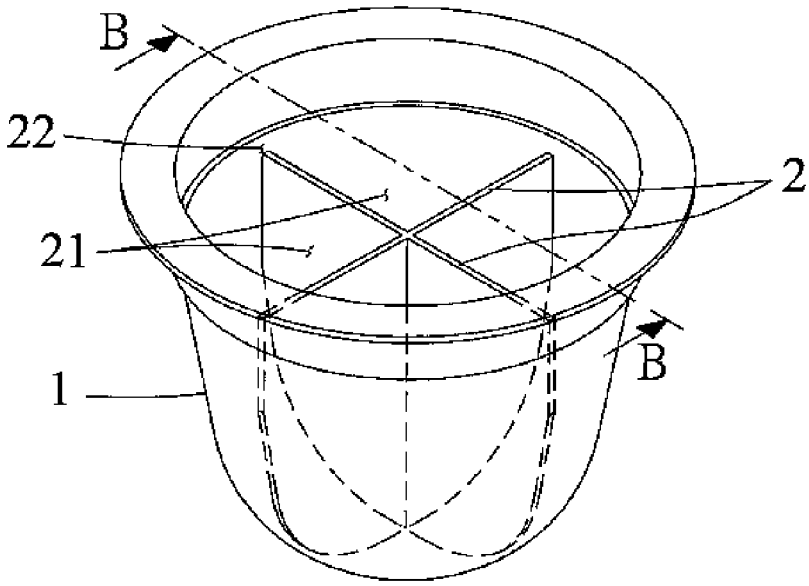
FIG. 6 is a perspective view of a jelly-containing device in accordance with another embodiment of the present invention.
Figure 7:
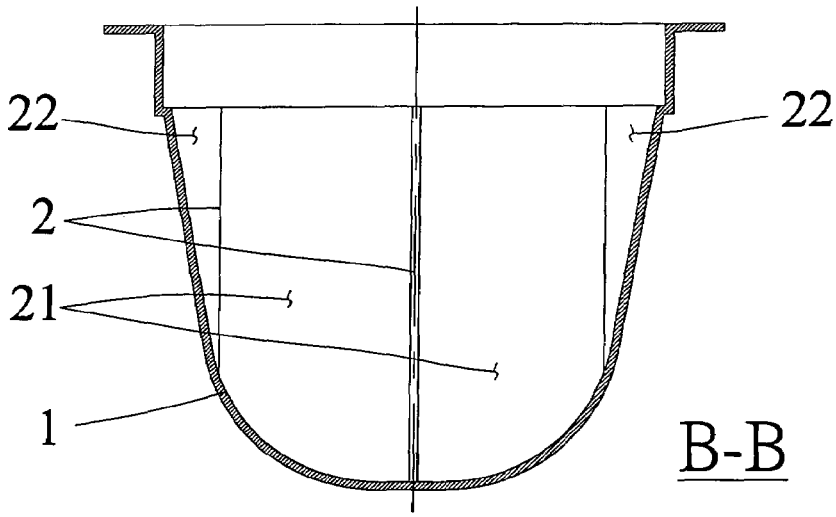
FIG. 7 is a cross sectional view of the jelly-containing device of the second embodiment taken along the line B—B of FIG. 6.
Figure 8:
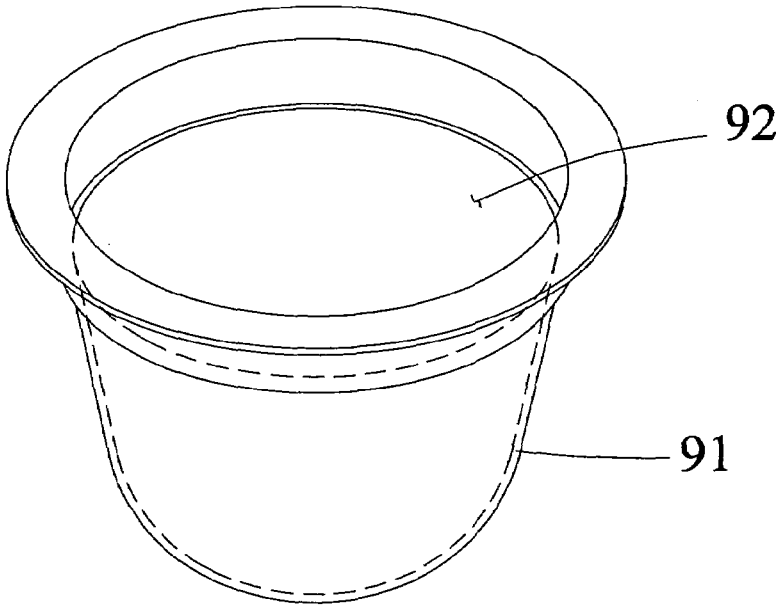
FIG. 8 PRIOR ART
FIG. 8 is a perspective view of a conventional jelly-containing device.
Figure 9:
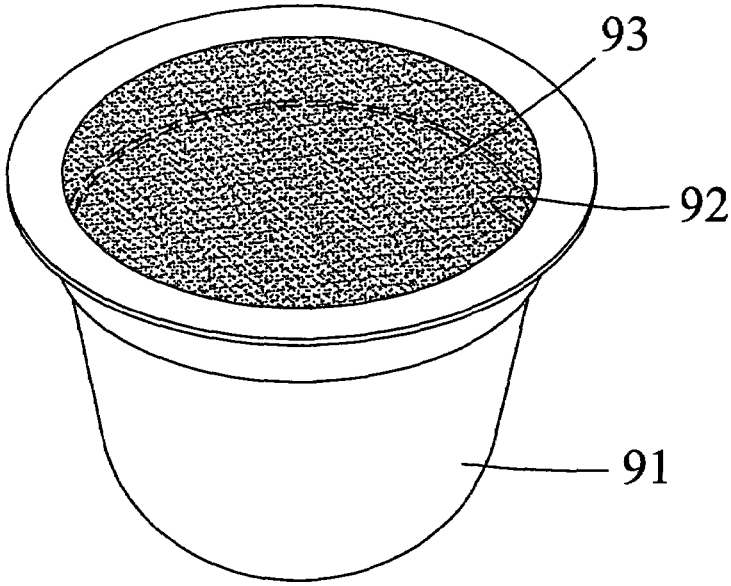
FIG.9 PRIOR ART
FIG. 9 shows the conventional jelly-containing device stored with jelly.
Figure 10:
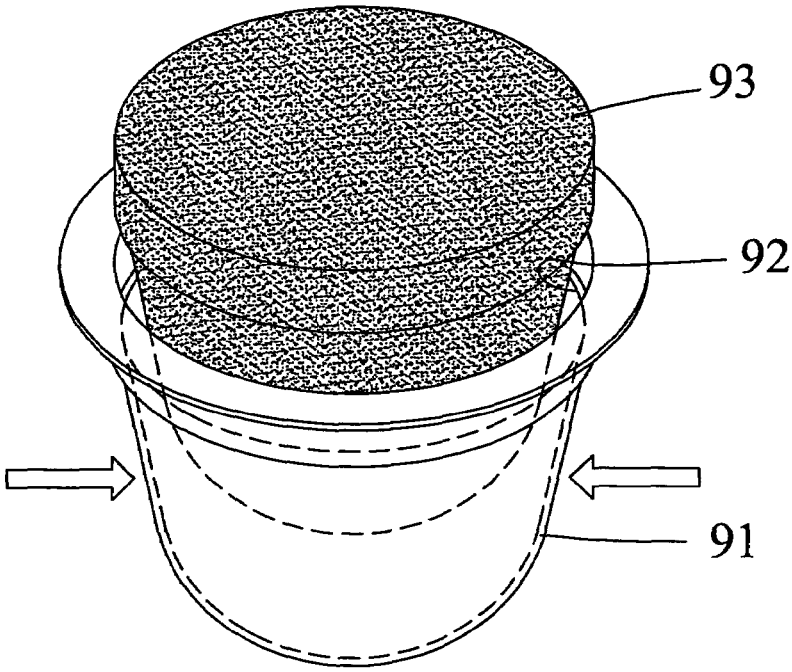
FIG.10 PRIOR ART
FIG. 10 shows the jelly being partially squeezed out of the conventional jelly-containing device.

The lateral edges of the spacers 2 also can be partially integral with the internal wall of the housing 1 (as shown in FIGS. 6 and 7). A clearance 22 is formed between the lateral edge of the spacers 2 and the housing 1, so as to improve the flexibility of the housing 1. Thus, the jelly 3 can be squeezed out of the housing 1 more easily. The clearances between the crossed cutting line 31 does not choke the esophagus, and the jelly 3 will be broken into pieces easily through sucking and chewing activities, thus eliminating the danger of choking.

While we have shown and described various embodiments in accordance with the present invention, it should be clear to those skilled in the art that further embodiments may be made without departing from the scope of the present invention.

What is claimed is:

1. A jelly-containing device comprising:

a flexible housing having a closed bottom, an open top, and a wall extending between the closed bottom and the open top, with the housing defining an inner space containing said jelly; and a plurality of spacers within the inner space of the flexible housing, with each spacer having a lower edge integrally formed with the closed bottom of the housing, an upper edge below the open top of the housing, and a lateral edge extending between the lower edge and the upper edge and being partially integral with the wall of the flexible housing, with the plurality of spacers dividing the inner space into a plurality of jelly-receiving spaces, with the lateral edges of the spacers being oriented relative to the wall of the flexible housing such that a portion of the lateral edges are not integral with the wall of the flexible housing such that clearances are present between the portion of the lateral edges and the wall of the flexible housing sufficient to improve the flexibility of the flexible housing, thus allowing the jelly to be squeezed out of the flexible housing more easily, said jelly filling the flexible housing including said jelly-receiving spaces and to a point above said upper edges of said spacers, such that the jelly is divided, by said spacers, into a number of portions equal to the number of jelly-receiving spaces, which portions are still partially connected to each other before and after being squeezed out of the flexible housing and its jelly-receiving spaces such that the jelly, free of the housing, and containing cross cutting lines caused by the spacers, will be easily broken through sucking and chewing, thus eliminating the danger of choking when the whole jelly is transferred to the mouth.

2. The jelly-containing device as claimed in claim 1, wherein the clearances extend to and terminate at the upper edges, with the upper edges being spaced from the wall of the housing.

3. The jelly-containing device as claimed in claim 2, wherein the upper edges are located in the inner space and below the open top of the flexible housing.

4. The jelly-containing device as claimed in claim 3, wherein each of the plurality of spacers extend diagonally between the wall, with mid-portions of the plurality of spacers intersecting with each other.

5. The jelly-containing device as claimed in claim 4, wherein the plurality of jelly-receiving spaces equally divide the inner space.

6. The jelly-containing device as claimed in claim 5, wherein each of the plurality of spacers are flexible sheet-shaped structures.

7. The jelly-containing device as claimed in claim 6, wherein the number of jelly-receiving spaces is equal to two times the number of spacers.

* * * * *